United States Patent [19]

Tippmann

[11] Patent Number: 4,547,995

[45] Date of Patent: Oct. 22, 1985

[54] REMOVABLE SASH GUIDE FOR WINDOW FRAMES

[75] Inventor: Eugene R. Tippmann, Fort Wayne, Ind.

[73] Assignee: Lakeview Window Corporation, Fort Wayne, Ind.

[21] Appl. No.: 537,848

[22] Filed: Sep. 30, 1983

[51] Int. Cl.[4] ..... E05D 15/00

[52] U.S. Cl. ..... 49/457

[58] Field of Search ..... 49/457, 456, 453, 454, 49/459, 194

[56] References Cited

U.S. PATENT DOCUMENTS

| | | | |
|---|---|---|---|
| 702,586 | 6/1902 | Rasner | 49/457 |
| 942,269 | 12/1909 | Lee | 49/457 |
| 1,126,884 | 2/1915 | Schroyer | 49/456 X |
| 1,959,643 | 5/1934 | Plym | 49/457 X |

*Primary Examiner*—Philip C. Kannan

*Attorney, Agent, or Firm*—Joseph J. Baker

[57] ABSTRACT

A window construction is disclosed of the type having sashes slidable within a frame and maintained in alignment therein by means of guide strips adjacent the sashes which, due to their unique design, are capable of being removed from channels in the frame only when force is applied thereto from one side thereof to thereby ensure only removal of the sashes from one side of the frame.

6 Claims, 6 Drawing Figures

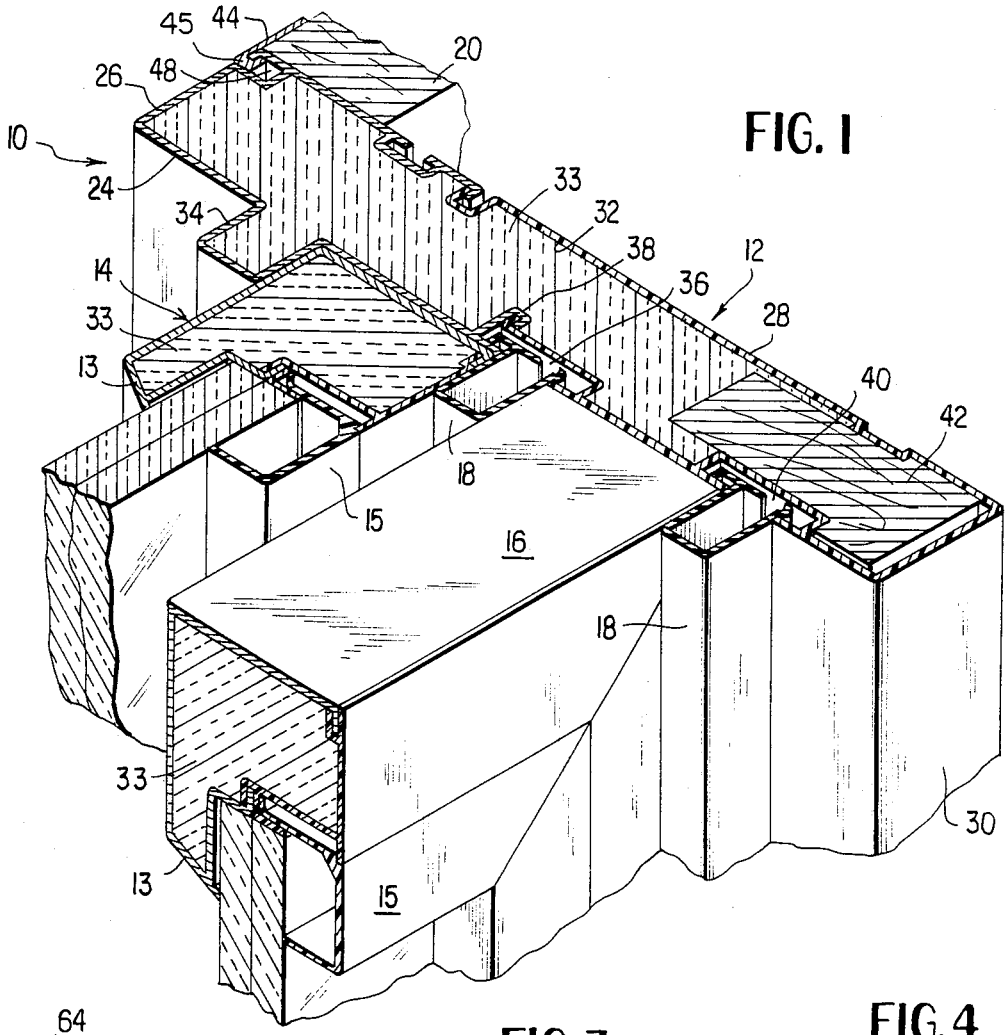
FIG. 1
FIG. 2
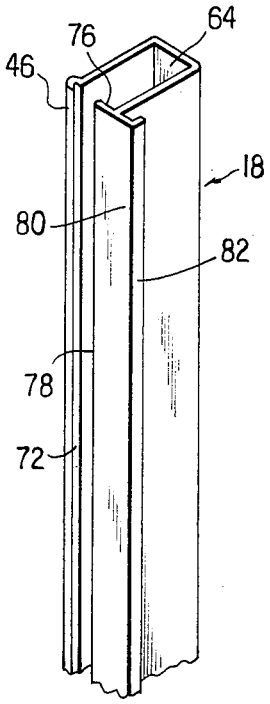
FIG. 3
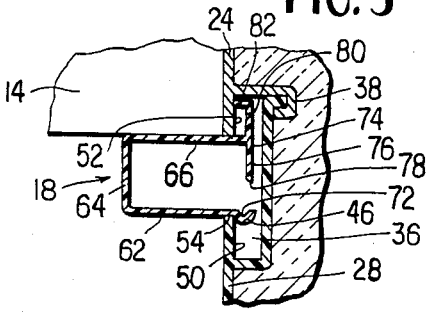
FIG. 4
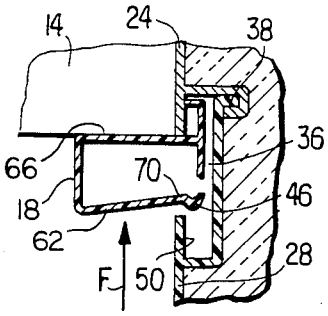
FIG. 5
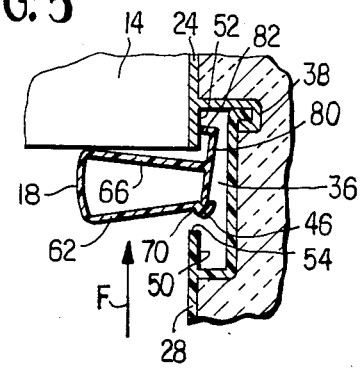
FIG. 6
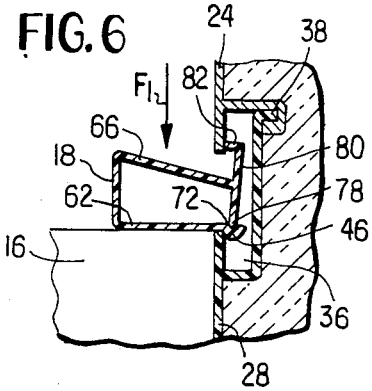

REMOVABLE SASH GUIDE FOR WINDOW FRAMES

BACKGROUND OF THE INVENTION

This invention relates to window constructions and more specifically to a parting strip design which permits their removal and that of the sashes from the frame only from one side of the frame.

Applicant is unaware of any window construction in the prior art utilizing the novel parting strip design of the present invention which permits removal of the sliding sashes from a window frame by removal of the strips guiding the sashes by the application of force on one side of the strip but not the other.

Window frame constructions which have removable strips which guide sliding sashes and act as blind, parting or inside stops are well known in the art. They often consist of single or folded lengths of sheet metal which are simply inserted into channels formed in the window frame and held there by friction. An example of such a prior art guide and window frame construction is shown in U.S. Pat. No. 702,586. As can be seen, the guide strips disclosed in the aforementioned patent can be removed from either side of the window frame resulting in the easy removal of the window sashes from either side of the frame. Other types of window frame construction which have removable guide strips maintain them in the frame channels by some mechanical means. An example of such a construction is shown in U.S. Pat. No. 942,269 wherein the guide strips have notches which engage projections in the channel. Again, the guide strips can be easily removed from the channels by merely raising them from either side of the frame until the notches clear the projections.

Obviously, ease of removal of the guide strip from the frame from the side of the frame facing outside of a house or other structure containing the window materially increases the ability of removing the sliding sashes from the frame to thereby permit entry through the window of an unauthorized nature.

It is therefore the primary object of the subject invention to provide a superior window construction of the sliding sash type.

It is another object of the present invention to provide a window construction which utilizes a novel guide strip removable from a channel in the window frame only from one side of the frame when the window sashes are in their non-overlapped position.

It is still another object of the present invention to provide a window construction which utilizes a novel guide strip that is held in a channel formed in the frame side members and can be removed from the channel by applying force to only one side of the guide strip.

It is yet another object of the present invention to provide a window construction utilizing novel sash guides particularly designed to facilitate the installation and removal of window sashes.

Numerous other objects and advantages of the invention will be particularly pointed out hereinafter or will become apparent from a reading of the specification and upon reference to the drawings.

BRIEF DESCRIPTION OF THE DRAWINGS

FIG. 1 is a detail perspective view showing in section the side of a window frame, the sash and various guide strips of the present invention.

FIG. 2 a perspective view of a length of the guide strip of the present invention.

FIG. 3 is a plan view of a portion of the frame of FIG. 1 showing the guide strip of the present invention positioned in a channel in the frame.

FIG. 4 is a plan view similar to FIG. 2 showing a force applied to one leg of the guide strip prior to its removal from the channel.

FIG. 5 is a plan view similar to FIG. 2 showing continued application of a force applied to the leg of the guide strip of FIG. 3 enabling it to be removed from the channel.

FIG. 6 is a plan view of a portion of the frame of FIG. 1 showing a force applied to another of the legs of the guide strip and showing its inability to be removed from the channel.

DETAILED DESCRIPTION OF PREFERRED EMBODIMENTS

Referring now to the drawings where like characters of reference indicate like elements in each of the several figures, FIG. 1 shows generally at 10 a portion of the window frame 12, upper sash 14, lower sash 16 and guide strips 18 of the present invention installed adjacent the framing 20 of a building structure.

The frame member 12 consists of spaced-apart horizontal and vertical side members, only one of the vertical side members 22 being shown here for simplicity. The other side members are all identical in cross-section to side member 22 shown and themselves comprise a metallic portion 24 which has a surface 26 facing the outside atmosphere when the frame 12 is installed in a wall opening in a building structure (not shown). The frame 22 also comprises a non-metallic portion 28 having a surface 30 facing the inside of the building structure and it is interlocked with the metallic portion 24 to create a cavity 32 which is filled with a low density insulating material 33 such as polyurethane or the like. The upper sash 14 and lower sash 16 are also constructed of interlocking metallic portions 13 and non-metallic portions 15 filled with insulating material 33. The frame member 12 and upper and lower sashes 14,16 are constructed in accordance with the principles taught in U.S. Pat. No. 4,299,060, the disclosure of which is incorporated herein by reference in its entirety. This unique combination of foam backed, interlocked, metallic and non-metallic frame members provides a window frame of superior insulating and rot resistant qualities.

The metallic portion of the frame 12 has a rectangular shaped fixed projection which acts as a blind stop 34 against which the outer sash 14 abuts and slides. The frame 12 also has a first channel 36 formed in and extends longitudinally at the interlocking junction 38 of the metallic and non-metallic portions 24, 28 respectively. A second channel 40 is formed in and extends longitudinally of the non-metallic portion 28 adjacent a length of wood 42. The wood 42 serves as a means through which nails can be driven to secure the frame 12 in the opening in the structure (not shown). A strip 44 has beaded end 45 and is slidably held in a channel 48 in the metallic portion 24. The strip 44 extends to the framing 20 and when attached thereto serves to seal off the junction of the metallic portion 24 and framing member 20. The first and second channels 36, 40 each have a first edge 50 and a second edge 52 adjacent an opening 54 into the channel 36 or 40.

The guide strip 18 (as can best be seen by referring to FIGS. 2–6) is positioned in first channel 36 and it acts as a parting stop between the upper sash 14 and lower sash 16. Similarly, guide strip 18 positioned in second channel 40 acts as an inside stop to and maintain the lower sash 16 in the frame 12. The strip guide 18 is substantially U-shaped and comprises a first leg connected at one end thereof to an intermediate portion 64 and a second leg 66 also connected at one of its ends to the intermediate portion 64. The strip guide 18 can be made of resilient plastic-like material. The first leg 62 of the guide strip 18 has the beaded end 46 extending the length threof. The beaded end 46 has a surface 70 which engages first edge 50 to help maintain the guide strip 18 in the opening 54 and channels 36, 40 during normal use. The beaded end 46 also has a notch 72 formed in the surface thereof, the function of which will be fully described later.

The second leg 66 has an arm 74 integrally formed on the other end thereof approximate its midpoint. The arm 74 has a first section 76 which is slightly tapered to an end 78 and a second section 80 has a projection 82 on the end thereof which serves to maintain the guide strip 18 in the opening 54 and channels 36, 40 during normal use, as shown in FIG. 3.

The guide strip 18 can be easily removed from the channel 36 or 40 to facilitate removal of the sashes 14, 16 for cleaning or replacement by applying a force F against leg 62 as shown in FIG. 4. By this force F, the beaded end 46, being small in diameter, is capable of being moved out of engagement with the first edge 50 thereby permitting it to swing out of opening 54. Once the bead 46 clears the opening 54 as shown in FIG. 5, the second section 80 of arm 74 can be drawn past second edge 52 thereby enabling the guide strip 18 to be removed. As will be noted the removal of the guide strip 18 in the aforedescribed manner is possible even though one of the sashes (in this instance upper sash 14) is adjacent the leg 66 of the guide strip 18. The force F shown in FIGS. 4 and 5 is being applied from the side of the frame 12 which normally faces the inside of a building structure.

If on the other hand an attempt is made to remove the guide strip 18 by applying a force $F_1$ from the side of the frame 12 which normally faces the outside of a building structure as shown in FIG. 6. As can be seen application of the force $F_1$ against leg 66 causes the first section 76 and more specifically the end 78 thereon is caused to engage the notch 72 on the beaded end 46 thus keeping the beaded end 46 against the first edge 50. In addition, the length of the section 80 of arm 74 and that of the projection 82 are so chosen that they will not permit the section 80 to clear second edge 52. Thus, the guide strip is prevented from being removed from the channels 36, 40 from the side of the frame 12 normally facing the outside of a building structure by, for example, an unauthorized person. The notch 78 holds the end 78 and prevents it from rolling over the beaded end 46 even when the application of force $F_1$ is great and a sash member such as 16 is adjacent the leg 62.

Applicant has thus described in detail his novel guide strip which can be removed by an application of force thereto from one side of the frame but not the other.

I claim:

1. A guide strip adapted to be removably held in a channel having an opening formed in the side members of a frame of a double sash window, said guide strip comprising:

(a) a pair of parallel, spaced-apart legs connected at one end thereof by an intermediate portion, said legs providing a stop against which each of said sashes may slide, (b) latching means on the other ends of said legs for maintaining said legs in said opening, and (c) cooperating means for preventing said legs from being removed from said opening when one of said legs is moved by force toward said other of said legs.

2. A guide strip as set forth in claim 1 wherein said latching means comprises an arm member secured to one of said legs at the other end thereof and a bead member secured to the other of said legs at the other end thereof, said arm member and said bead member each having a surface for engaging said channel.

3. A guide strip as set forth in claim 2 wherein said cooperating means is a projection secured to one of said legs at said other end thereof and a notch formed in said bead member for receiving said projection to thereby prevent said arm member and said bead member from being removed from said channel when one of said legs is moved under pressure toward said other of said legs.

4. A window construction of the type having two sliding sashes comprising:

(1) a frame consisting of horizontal and upright members to which said sashes are fitted, said upright members each having at least one channel extending the length thereof with an opening formed therein, (2) a guide strip positioned in each of said channels and extending through said opening to maintain said sliding sashes in alignment in said frame, said guide strip having a pair of parallel, spaced-apart legs connected at one end thereof by an intermediate portion, a latching means on the other ends of said legs for maintaining said legs in said opening, and cooperating means for preventing said legs from being removed from said opening when one of said legs is moved by force toward said other of said legs.

5. window construction as set forth in claim 4 wherein said latching means comprises an arm member secured to one of said legs at the other end thereof and a bead member secured to the other of said legs at the other end thereof, said arm member and said bead member each having a surface for engaging said channel.

6. A window construction as set forth in claim 5 wherein said cooperating means is a projection secured to one of said legs at said other end thereof and a notch formed in said bead member for receiving said projection to thereby prevent said arm member and said bead member from being removed from said channel when one of said legs is moved under pressure toward said other of said legs.

* * * * *